US010068697B2

(12) United States Patent
Yoon et al.

(10) Patent No.: US 10,068,697 B2
(45) Date of Patent: Sep. 4, 2018

(54) COIL COMPONENT AND BOARD HAVING THE SAME

(71) Applicant: SAMSUNG ELECTRO-MECHANICS CO., LTD., Suwon-Si, Gyeonggi-Do (KR)

(72) Inventors: Chan Yoon, Suwon-Si (KR); Dong Hwan Lee, Suwon-Si (KR); Young Ghyu Ahn, Suwon-Si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 611 days.

(21) Appl. No.: 14/625,340

(22) Filed: Feb. 18, 2015

(65) Prior Publication Data

US 2016/0078995 A1 Mar. 17, 2016

(30) Foreign Application Priority Data

Sep. 16, 2014 (KR) ..... 10-2014-0122894

(51) Int. Cl.

| | |
|---|---|
| ***H01F 5/00*** | (2006.01) |
| ***H01F 27/28*** | (2006.01) |
| ***H01F 27/29*** | (2006.01) |
| ***H01F 17/00*** | (2006.01) |

(52) U.S. Cl.

CPC ..... *H01F 27/292* (2013.01); *H01F 17/0013* (2013.01); *H01F 2017/0066* (2013.01)

(58) Field of Classification Search

USPC ..... 336/200, 223, 232

See application file for complete search history.

(56) References Cited

U.S. PATENT DOCUMENTS

| | | | | |
|---|---|---|---|---|
| 5,529,831 | A * | 6/1996 | Waga | H01F 17/0006 360/130.23 |
| 7,696,849 | B2 * | 4/2010 | Ito | H05K 3/3442 336/192 |
| 2002/0101318 | A1 * | 8/2002 | Smith | H01F 17/0013 336/126 |
| 2003/0043759 | A1 | 3/2003 | Yamaguchi | |

(Continued)

FOREIGN PATENT DOCUMENTS

| | | | |
|---|---|---|---|
| CN | 201219056 | Y | 4/2009 |
| CN | 201638632 | U | 11/2010 |

(Continued)

OTHER PUBLICATIONS

Chinese Office Action dated Jan. 3, 2017 issued in Chinese Patent Application No. 201510080757.0 (with English ranslation)

*Primary Examiner* — Ronald Hinson

(74) *Attorney, Agent, or Firm* — McDermott Will & Emery LLP

(57) ABSTRACT

There are provided a coil component and a board having the same. The coil component includes: a magnetic body including first and second coil parts disposed to be symmetrical to each other on one surface of a substrate on the basis of a central portion of the magnetic body and third and fourth coil parts disposed to be symmetrical to each other on the other surface of the substrate on the basis of the central portion of the magnetic body; and first to fourth external electrodes disposed on outer surfaces of the magnetic body and connected to the first to fourth coil parts.

14 Claims, 7 Drawing Sheets

(56) References Cited

U.S. PATENT DOCUMENTS

| | | | | |
|---|---|---|---|---|
| 2003/0137384 | A1* | 7/2003 | Itou | H01F 17/0013 336/200 |
| 2006/0238273 | A1* | 10/2006 | Tomonari | H01F 17/0013 333/185 |
| 2011/0025442 | A1* | 2/2011 | Hsieh | H01F 17/0013 336/200 |
| 2011/0050191 | A1 | 3/2011 | Tsuji et al. | |

FOREIGN PATENT DOCUMENTS

| | | | |
|---|---|---|---|
| CN | 102005279 | A | 4/2011 |
| CN | 202905385 | U | 4/2013 |
| JP | 05-014007 | A | 1/1993 |
| JP | 2000-114052 | A | 4/2000 |
| KR | 2003-0022029 | A | 3/2003 |
| KR | 10-2005-0011090 | A | 1/2005 |

* cited by examiner

COIL COMPONENT AND BOARD HAVING THE SAME

CROSS-REFERENCE TO RELATED APPLICATION

This application claims the priority and benefit of Korean Patent Application No. 10-2014-0122894 filed on Sep. 16, 2014, with the Korean Intellectual Property Office, the disclosure of which is incorporated herein by reference.

BACKGROUND

The present disclosure relates to a coil component and a board having the same.

Electronic products such as digital televisions, smartphones, and notebook computers, have commonly transmitted and received data in a high frequency (HF) band, and henceforth, it is expected that such information technology (IT) electronic products will be more frequently used in practical applications, since such devices are able to function independently and are also able to be connected to one another via universal serial bus (USB) or other communications ports to have multiple functions and high degrees of integration.

As smartphones have been developed, demand for highly efficient and highly functional small and thin power inductors able to operate at high levels of current has increased.

Therefore, currently, a 2016-sized product having a thickness of 1 mm has been used, instead of a 2520-sized product having a thickness of 1 mm commonly used in the past. Further, and it is expected that products will be further miniaturized to have 1608-size with a thickness of 0.8 mm.

Simultaneously, demand for an array having a reduced mounting area has also increased.

The array may have a coupled or non-coupled inductor form or a combination thereof, according to a coupling coefficient or mutual inductance between a plurality of coil parts.

Meanwhile, in a case of a non-coupled inductor array chip in which a plurality of coils are disposed to be spaced apart from each other such that they are not mutually affected by magnetic fluxes generated thereby, if each of the coils is formed to have the same inductance, the inductor array chip may have improved efficiency as well as a reduction in a mounting area thereof.

There has been demand for non-coupled inductor array chips in various applications. However, such a non-coupled inductor array chip is problematic in that coils provided therein may not have the same inductance value.

Therefore, there is a need to manufacture a non-coupled inductor array product in which each coil has the same inductance value.

RELATED ART DOCUMENT (Patent Document 1) Korean Patent Laid-Open Publication No. 2005-0011090

SUMMARY

An aspect of the present disclosure may provide a coil component and a board having the same.

According to an aspect of the present disclosure, a coil component may include: a magnetic body including first and second coil parts disposed to be symmetrical to each other on one surface of a substrate on the basis of a central portion of the magnetic body and third and fourth coil parts disposed to be symmetrical to each other on the other surface of the substrate on the basis of the central portion of the magnetic body; and first to fourth external electrodes disposed on outer surfaces of the magnetic body and connected to the first to fourth coil parts.

According to another aspect of the present disclosure, a board having a coil component may include: a printed circuit board on which a plurality of electrode pads are provided; and the coil component mounted on the printed circuit board, wherein the coil component includes: a magnetic body including first and second coil parts disposed to be symmetrical to each other on one surface of a substrate on the basis of a central portion of the magnetic body and third and fourth coil parts disposed to be symmetrical to each other on the other surface of the substrate on the basis of the central portion of the magnetic body; and first to fourth external electrodes disposed on outer surfaces of the magnetic body and connected to the first to fourth coil parts.

BRIEF DESCRIPTION OF DRAWINGS

The above and other aspects, features and advantages of the present disclosure will be more clearly understood from the following detailed description taken in conjunction with the accompanying drawings, in which.

DETAILED DESCRIPTION

Figure 1:
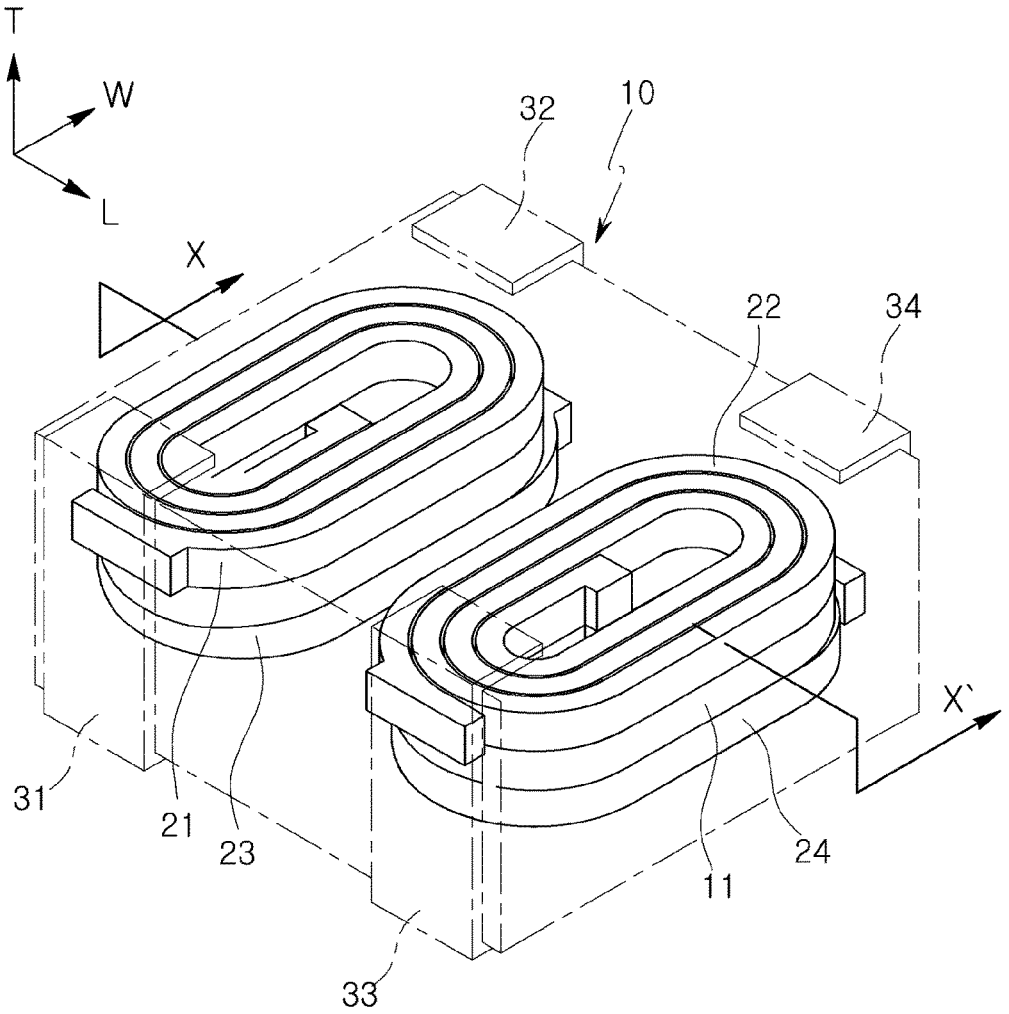
FIG. 1 is a perspective view of a coil component according to a first exemplary embodiment in the present disclosure.

Exemplary embodiments of the present disclosure will now be described in detail with reference to the accompanying drawings.

The disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Coil Component

A coil component according to an exemplary embodiment in the present disclosure may include: a magnetic body including first and second coil parts disposed to be symmetrical to each other on one surface of a substrate on the basis of a central portion of the magnetic body and third and fourth coil parts disposed to be symmetrical to each other on the other surface of the substrate on the basis of the central portion of the magnetic body; and first to fourth external electrodes disposed on outer surfaces of the magnetic body and connected to the first to fourth coil parts.

Here, the terms "first" to "fourth" are used in order to distinguish corresponding elements from one another, regardless of the order of the corresponding elements.

The magnetic body may be a hexahedron, and with regard to the directions of the magnetic body 10, an "L direction" may refer to a "length direction", a "W direction" may refer to a "width direction" and a "T direction" may refer to a "thickness direction".

The magnetic body may include the substrate, the first and second coil parts disposed to be symmetrical to each other on one surface of the substrate on the basis of the central portion of the magnetic body, and the third and fourth coil parts disposed to be symmetrical to each other on the other surface of the substrate on the basis of the central portion of the magnetic body.

The substrate may be a magnetic substrate, and the magnetic substrate may contain nickel-zinc-copper ferrite, but is not limited thereto.

In addition, the coil component according to the exemplary embodiment may include the first and third external electrodes formed on one surface of the magnetic body and the second and fourth external electrodes formed on the other surface of the magnetic body opposing one surface of the magnetic body.

Hereinafter, the first to fourth coil parts 21 to 24 and the first to fourth external electrodes 31 to 34 will be described with reference to the accompanying drawings.

FIG. 1 is a perspective view of a coil component according to a first exemplary embodiment in the present disclosure.

Figure 2:
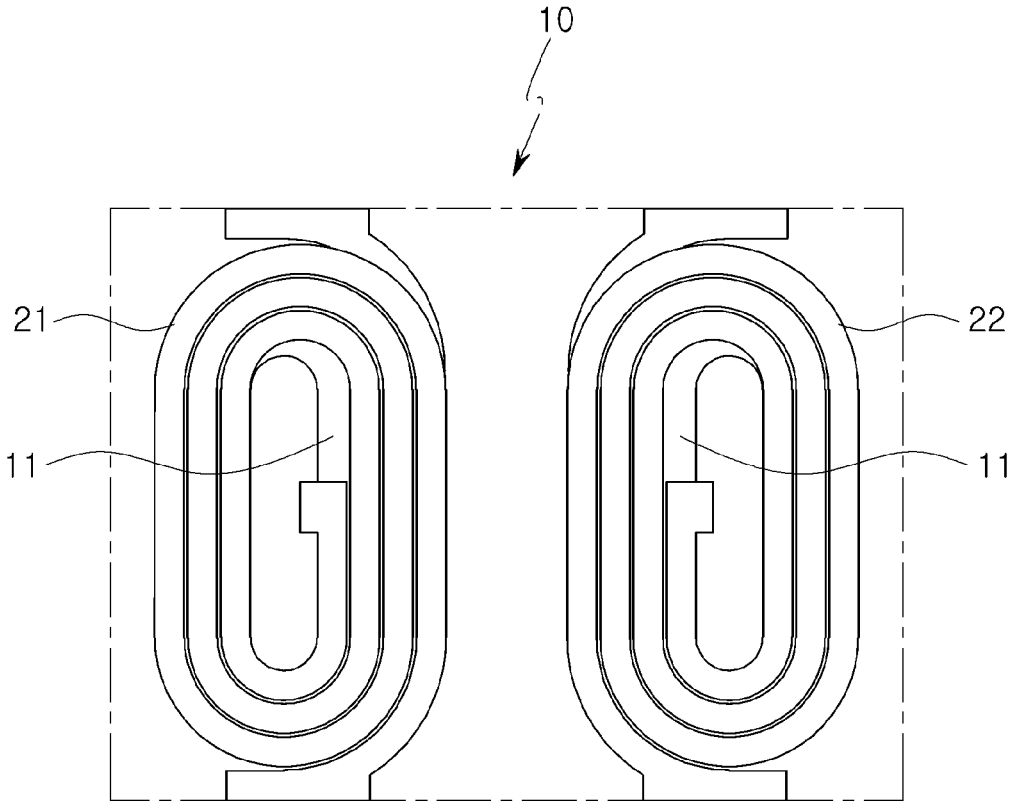
FIG. 2 is a plan view of the interior of the coil component, which is viewed from the top of FIG. 1.

FIG. 2 is a plan view of the interior of the coil component, which is viewed from the top of FIG. 1.

Figure 3:
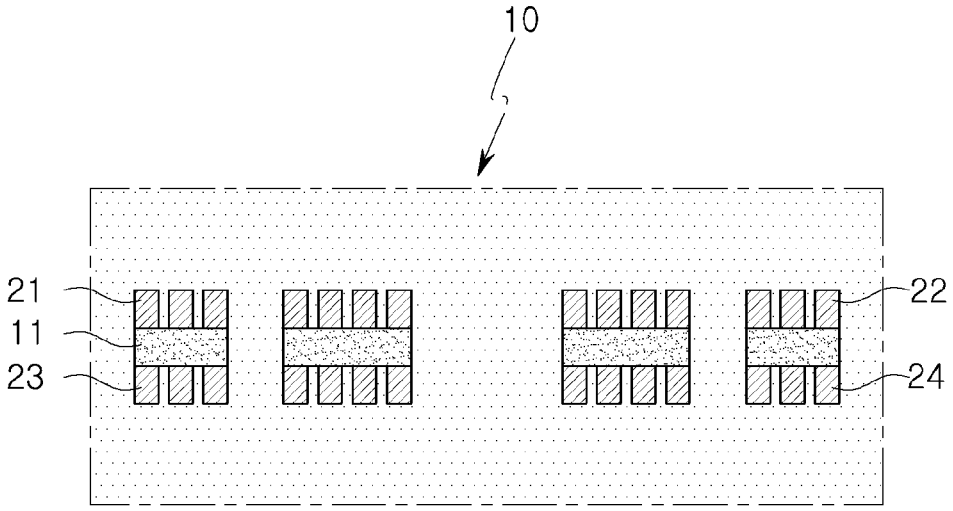
FIG. 3 is a cross-sectional view taken along line X-X' of FIG. 1.

FIG. 3 is a cross-sectional view taken along line X-X' of FIG. 1.

Referring to FIGS. 1 through 3, the coil component according to this exemplary embodiment may include: a magnetic body 10 including first and second coil parts 21 and 22 disposed to be symmetrical to each other on one surface of a substrate 11 on the basis of a central portion of the magnetic body 10 and third and fourth coil parts 23 and 24 disposed to be symmetrical to each other on the other surface of the substrate 11 on the basis of the central portion of the magnetic body 10; and first to fourth external electrodes 31 to 34 disposed on outer surfaces of the magnetic body 10 and connected to the first to fourth coil parts 21 to 24.

The coil component according to the present exemplary embodiment may include the first and third external electrodes 31 and 33 formed on one surface of the magnetic body 10 and the second and fourth external electrodes 32 and 34 formed on the other surface of the magnetic body 10 opposing one surface of the magnetic body 10.

Referring to FIGS. 1 through 3, the first and second coil parts 21 and 22 may be disposed to be spaced apart from each other on one surface of the substrate 11 and may be symmetrical to each other on the basis of the central portion of the magnetic body 10 in the length direction thereof.

Further, the third and fourth coil parts 23 and 24 may be disposed to be spaced apart from each other on the other surface of the substrate 11 and may be symmetrical to each other on the basis of the central portion of the magnetic body 10 in the length direction thereof.

The first and second coil parts 21 and 22 may be symmetrically mirrored on the basis of the central portion of the magnetic body 10, and the third and fourth coil parts 23 and 24 may also be symmetrically mirrored on the basis of the central portion of the magnetic body 10.

The central portion of the magnetic body 10 may refer to a central region of the magnetic body 10 in the length direction thereof, but does not refer to a point which is accurately positioned to have the same distance from both end portions of the magnetic body 10 in the length direction.

The center of each of the first and second coil parts 21 and 22 which are wound on one surface of the substrate may be referred to as a core, and hereinafter, will be used as the same concept.

Further, the center of the third coil part 23 which is wound on the other surface of the substrate 11 and the center of the fourth coil part 24 which is wound on the other surface of the substrate 11 may be referred to as cores, respectively, such that the substrate 11 may have two cores.

According to the exemplary embodiment, the first and second coil parts 21 and 22 may be symmetric to each other on the basis of the central portion of the magnetic body such that the first and second coil parts 21 and 22 have the same inductance value, and the third and fourth coil parts 23 and 24 may be symmetric to each other on the basis of the central portion of the magnetic body such that the third and fourth coil parts 23 and 24 have the same inductance value.

In addition, unlike a structure of coil parts according to the related art, the first and second coil parts 21 and 22 and the third and fourth coil parts 23 and 24 may be symmetrically mirrored on the basis of the central portion of the magnetic body 10, and thus, the first and second coil parts 21 and 22 and the third and fourth coil parts 23 and 24 may have the same inductance value.

Particularly, according to this exemplary embodiment, portions of the first to fourth coil parts 21 to 24 adjacent to the central portion of the magnetic may have higher coil densities than portions thereof adjacent to end portions of the magnetic body 10.

Each of the first to fourth coil parts 21 to 24 may be provided to have a higher coil density in a region thereof adjacent to the central portion of the magnetic body 10 than in a region thereof adjacent to the end portions of the magnetic body 10, whereby self inductance may be increased.

Referring to FIG. 3, it can be seen that the number of coil turns in the region of each of the first to fourth coil parts adjacent to the central portion of the magnetic body 10 is four, and the number of coil turns in the region of each of the first to fourth coil parts adjacent to the end portions of the magnetic body 10 is three.

That is, according to this exemplary embodiment, by allowing each of the first to fourth coil parts 21 to 24 to have a higher coil density in the region thereof adjacent to the central portion of the magnetic body 10 than in the region thereof adjacent to the end portions of the magnetic body 10, self inductance may be increased.

The number of coil turns shown in FIG. 3 is merely exemplary, and the present inventive concept is not limited thereto.

Meanwhile, one ends of the first and second coil parts 21 and 22 may be exposed to one side surface of the magnetic body 10 in the width direction thereof, and one ends of the third and fourth coil parts 23 and 24 may be exposed to the other side surface of the magnetic body 10 in the width direction thereof, such that one ends of the first and second coil parts 21 and 22 and one ends of the third and fourth coil parts 23 and 24 may be connected to the first to fourth external electrodes 31 to 34, respectively.

That is, in a case in which one end of the first coil part 21 is exposed to a first side surface of the magnetic body 10 in the width direction thereof, one end of the second coil part 22 disposed to be spaced apart from the first coil part 21 on the same plane and wound to be symmetrical to the first coil part 21 on the basis of the central portion of the magnetic body 10 may be exposed to the first side surface of the magnetic body 10 in the width direction thereof.

The exposed end of the first coil part 21 may be connected to the first external electrode 31, and the exposed end of the second coil part 22 may be connected to the third external electrode 33.

Further, the first and second coil parts 21 and 22 may be symmetrical to each other on the basis of the center of the magnetic body 10.

Due to the above-mentioned feature, the first and second coil parts 21 and 22 may have the same length.

Similarly, one end of the third coil part 23 disposed on the other surface of the substrate 11 may be exposed to a second side surface of the magnetic body 10 opposing to the first side surface thereof in the width direction thereof.

In addition, one end of the fourth coil part 24 disposed to be spaced apart from the third coil part 23 on the same plane and wound to be symmetrical to the third coil part 23 on the basis of the central portion of the magnetic body 10 may be exposed to the second side surface of the magnetic body 10 in the width direction thereof.

The exposed end of the third coil part 23 may be connected to the second external electrode 32, and the exposed end of the fourth coil part 24 may be connected to the third external electrode 33.

In addition, the third and fourth coil parts 23 and 24 may have the same length.

As described above, the first to fourth coil parts 21 to 24 are exposed to one surface and the other surface of the magnetic body 10 in the width direction thereof while being spaced apart from each other, such that the first to fourth coil parts 21 to 24 may be connected to the first to fourth external electrodes 31 to 34, respectively.

The first and third external electrodes 31 and 33 may be input terminals, and the second and fourth external electrodes 32 and 34 may be output terminals, but the present inventive concept is not limited thereto.

Meanwhile, the first and second coil parts 21 and 22 may be formed on the same plane, which is the upper portion of the magnetic substrate 11, the third and fourth coil parts 23 and 24 may be formed on the same plane, which is the lower surface of the magnetic substrate 11, and the first and third coil parts 21 and 23 may be connected to each other through a via electrode (not shown).

Similarly, the second and fourth coil parts 22 and 24 may be connected to each other through a via electrode (not shown).

Therefore, a current input through the first external electrode 31, the input terminal, may pass through the first coil part 21, the via electrode, and the third coil part 23 to flow toward the second external electrode 33, the output terminal.

Similarly, a current input through the third external electrode 33, the input terminal, may pass through the second coil part 22, the via electrode, and the fourth coil part 24 to flow toward the fourth external electrode 34, the output terminal.

The first and second coil parts 21 and 22 may be symmetrically mirrored on the basis of the central portion of the magnetic body 10, and the third and fourth coil parts 23 and 23 may also be symmetrically mirrored on the basis of the central portion of the magnetic body 10, such that the coil component according to this exemplary embodiment may have a non-coupled inductor array form.

Further, due to the above-mentioned structure, the first and second coil parts 21 and 22 and the third and fourth coil parts 23 and 24 disposed on the upper and lower surfaces of the substrate 11, respectively, may have magnetic fluxes which flow symmetrically.

Therefore, since the coil parts are symmetrically mirrored on the basis of the central portion of the coil component, they may have the same inductance, whereby efficiency of an inductor array chip may be improved as well as a reduction in a mounting area thereof.

The first to fourth coil parts 21 to 24 may contain at least one selected from the group consisting of gold, silver, platinum, copper, nickel, palladium, and alloys thereof.

The first to fourth coil parts 21 to 24 may be formed of any material as long as the material may impart conductivity to the coil parts, and the material of the coil parts is not limited to the above-mentioned metals.

Further, the first to fourth coil parts 21 to 24 may have a polygonal, circular, oval, or irregular shape, and the shape thereof is not particularly limited.

The first to fourth coil parts 21 to 24 may be connected to the first to fourth external electrodes 31 to 34 through lead terminals (not shown), respectively.

The external electrode may include the first to fourth external electrodes 31 to 34.

The first to fourth external electrodes 31 to 34 may be extended in the thickness direction ("T direction") of the magnetic body 10.

The first to fourth external electrodes 31 to 34 may be disposed to be spaced apart from each other to thereby be electrically isolated from each other.

The first to fourth external electrodes 31 to 34 may be extended to portions of the upper and lower surfaces of the magnetic body 10.

Since portions of the first to fourth external electrodes 31 to 34 bonded to the magnetic body 10 have an angled shape, adhesive force between the first to fourth external electrodes 31 to 34 and the magnetic body 10 may be improved, whereby impact resistance and the like may be improved.

A metal forming the first to fourth external electrodes 31 to 34 is not particularly limited as long as the metal may impart electrical conductivity to the first to fourth external electrodes 31 to 34.

More specifically, the first to fourth external electrodes 31 to 34 may contain at least one selected from the group consisting of gold, silver, platinum, copper, nickel, palladium, and alloys thereof.

Gold, silver, platinum, and palladium are expensive but are stable, while copper and nickel are inexpensive but may be oxidized during a sintering process to thereby decrease electrical conductivity.

A thickness of the magnetic body 10 may be 1.2 mm or less, but is not limited thereto. The thickness of the magnetic body 10 may be varied.

Figure 4:
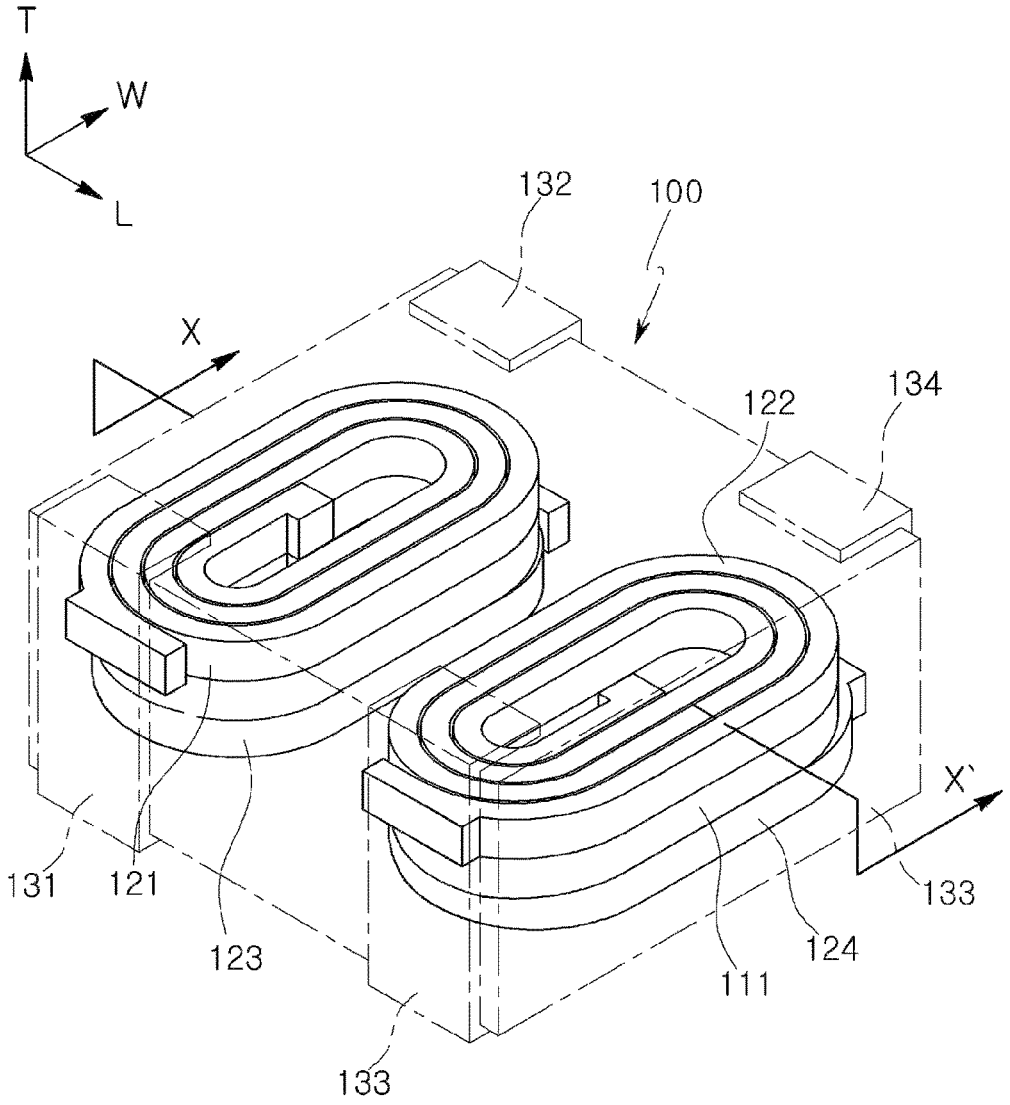
FIG. 4 is a perspective view of a coil component according to a second exemplary embodiment in the present disclosure.

FIG. 4 is a perspective view of a coil component according to a second exemplary embodiment in the present disclosure.

Figure 5:
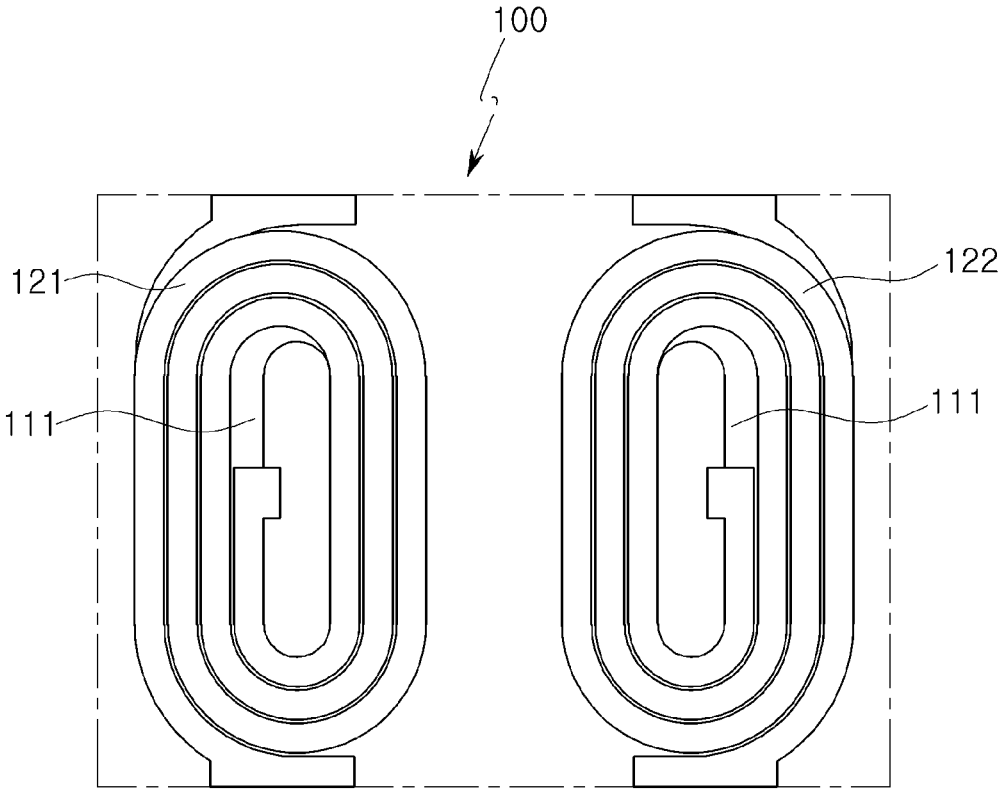
FIG. 5 is a plan view of the interior of the coil component, which is viewed from the top of FIG. 4.

FIG. 5 is a plan view of the interior of the coil component, which is viewed from the top of FIG. 4.

Figure 6:
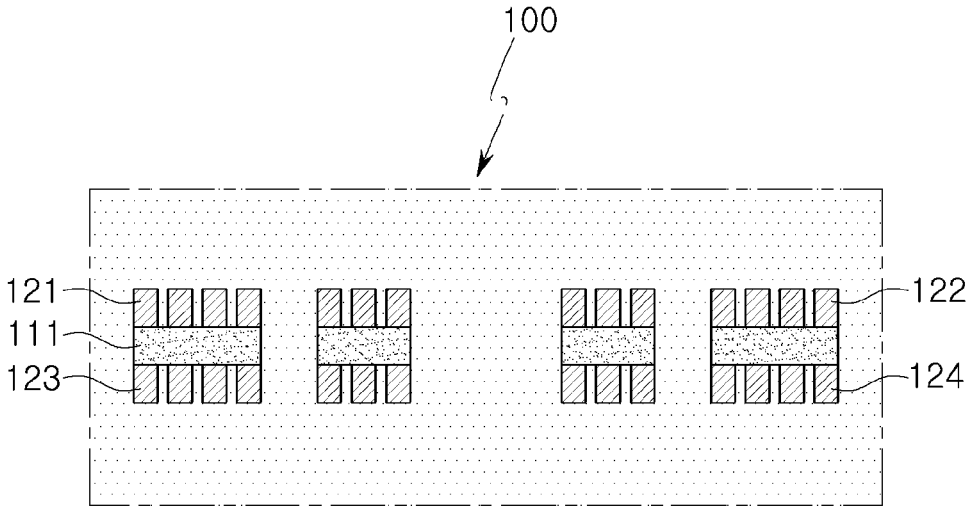
FIG. 6 is a cross-sectional view taken along line X-X' of FIG. 4.

FIG. 6 is a cross-sectional view taken along line X-X' of FIG. 4.

Referring to FIGS. 4 through 6, the coil component according to this exemplary embodiment may include: a magnetic body 100 including first and second coil parts 121 and 122 disposed to be symmetrically to each other on one surface of a substrate 111 on the basis of a central portion of the magnetic body 100 and third and fourth coil parts 123 and 124 disposed to be symmetrically to each other on the other surface of the substrate 111 on the basis of the central portion of the magnetic body 100; and first to fourth external electrodes 131 to 134 disposed on outer surfaces of the magnetic body 100 and connected to the first to fourth coil parts 121 to 124.

The first and second coil parts 121 and 122 may be symmetric to each other on the basis of the central portion of the magnetic body 100 such that the first and second coil parts 121 and 122 have the same inductance value, and the third and fourth coil parts 123 and 124 may be symmetric to each other on the basis of the central portion of the magnetic body 100 such that the third and fourth coil parts 123 and 124 have the same inductance value.

In addition, unlike a structure of coil parts according to the related art, the first and second coil parts 121 and 122 and the third and fourth coil parts 123 and 124 may be symmetrically mirrored on the basis of the central portion of the magnetic body 100, and thus, the first and second coil parts 121 and 122 and the third and fourth coil parts 123 and 124 may have the same inductance value.

Particularly, according to this exemplary embodiment, portions of the first to fourth coil parts 121 to 124 adjacent to the central portion of the magnetic body 100 may have lower coil densities than portions thereof adjacent to end portions of the magnetic body 100.

Each of the first to fourth coil parts 121 to 124 may be provided to have a lower coil density in a region thereof adjacent to the central portion of the magnetic body 100 than in a region thereof adjacent to the end portions of the magnetic body 100, whereby self inductance may be decreased and coupling coefficient may be decreased.

That is, as compared to the first exemplary embodiment, adjacent coil parts may be less mutually affected by magnetic fluxes.

Referring to FIG. 6, it can be seen that the number of coil turns in the region of each of the first to fourth coil parts 121 to 124 adjacent to the central portion of the magnetic body 100 is three, and the number of coil turns in the region of each of the first to fourth coil parts 121 to 124 adjacent to the end portions of the magnetic body 100 is four.

That is, according to this exemplary embodiment, by allowing each of the first to fourth coil parts 121 to 124 to have a lower coil density in the region thereof adjacent to the central portion of the magnetic body 100 than in the region thereof adjacent to the end portions of the magnetic body 100, coupling coefficient may be decreased.

The number of coil turns shown in FIG. 6 is merely exemplary, and the present inventive concept is not limited thereto.

Since other features of the coil component 100 except for the above-mentioned features thereof are the same as those of the coil component 10 according to the first exemplary embodiment, a detailed description thereof will be omitted in order to avoid redundancy.

The following table 1 shows inductance and coupling coefficient values of coil components according to inventive examples 1 and 2 and a general non-coupled inductor according to a comparative example.

The coil component in inventive example 1 had the same structure as that of the coil component 10 according to the first exemplary embodiment, and the coil component in inventive example 2 had the same structure as that of the coil component 100 according to the second exemplary embodiment.

TABLE 1

| | Comparative Example | Inventive Example 1 | Inventive Example 2 |
|---|---|---|---|
| Self Inductance [μH] (First Coil Part/Second Coil Part) | 0.417/0.433 | 0.432/0.432 | 0.418/0.418 |
| Coupling Coefficient | −0.049 | 0.0644 | 0.0378 |

Referring to table 1, it can be seen that a general non-coupled inductor according to the comparative Example, adjacent coil parts had different self inductances.

On the other hand, it can be seen that the coil components according to the inventive examples, adjacent coil parts had the same self inductance.

Particularly, it can be seen that in inventive example 1 in which a coil density in a region of each coil part adjacent to a central portion of a magnetic body was higher than that in a region of the corresponding coil part adjacent to end portions of the magnetic body, self inductance was increased.

Further, in inventive example 2 in which a coil density in a region of each coil part adjacent to a central portion of a magnetic body was lower than that in a region of the corresponding coil part adjacent to end portions of the magnetic body, two coil parts were almost not mutually affected by magnetic fluxes, whereby coupling coefficient was significantly small (0.0378).

In table 1, as the coupling coefficient is closer to 1, the coupling coefficient is increased, and a (−) symbol refers to negative coupling.

Board Having Coil Component

Figure 7:
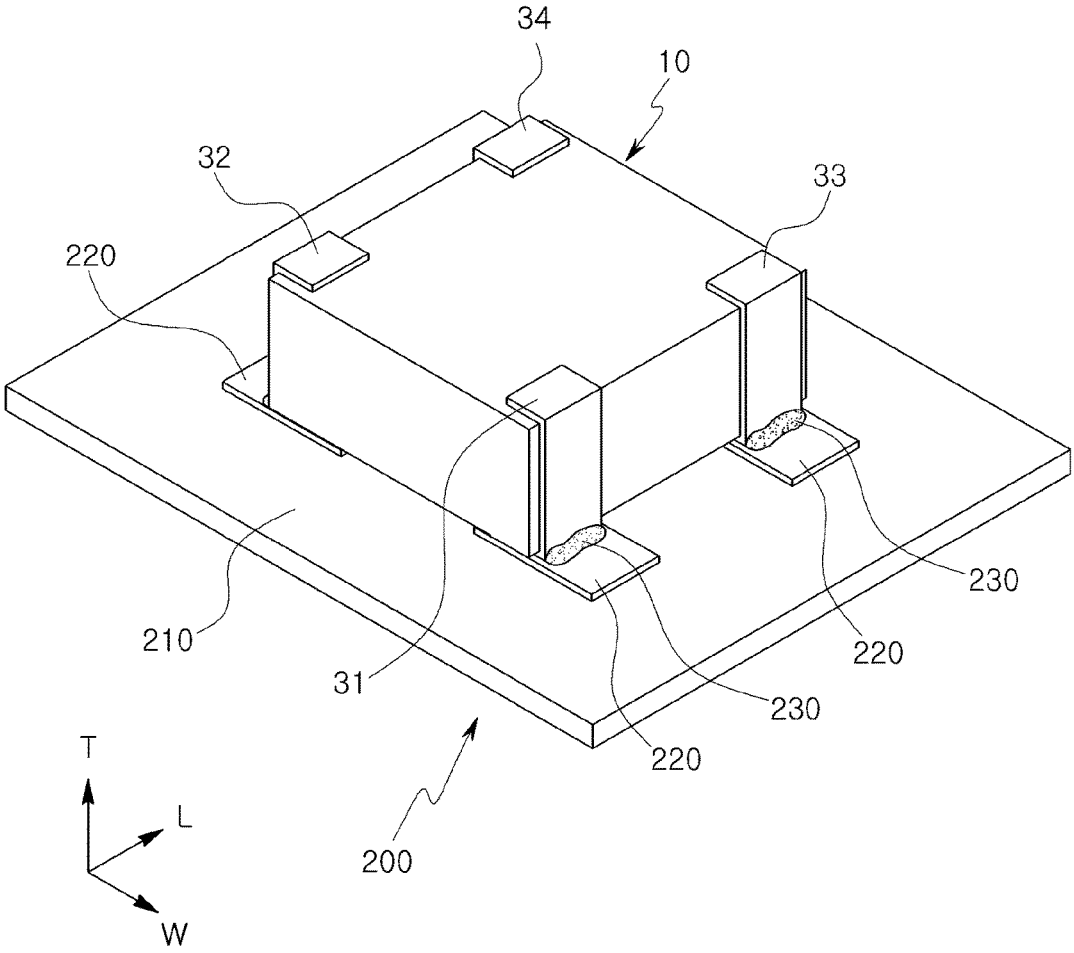
FIG. 7 is a perspective view of a board in which the coil component of FIG. 1 is mounted on a printed circuit board.

FIG. 7 is a perspective view of a board in which the coil component of FIG. 1 is mounted on a printed circuit board.

Referring to FIG. 7, aboard 200 having a coil component according to the present exemplary embodiment may include the coil component and a printed circuit board 210 on which the coil component is horizontally mounted, and a plurality of electrode pads 220 may be formed to be spaced apart from each other on an upper surface of the printed circuit board 210.

In this case, the coil component may be electrically connected to the printed circuit board 210 by solders 230 in a state in which the first to fourth external electrodes 31 to 34 are positioned to contact the electrode pads 220, respectively.

Except for the description described above, a description of features overlapped with those of the coil component according to the first exemplary embodiment will be omitted.

As set forth above, according to exemplary embodiments of the present disclosure, a coil component has a non-coupled inductor array form in which a plurality of coil parts are disposed to be spaced apart from each other so as to not be mutually affected by their magnetic fluxes, whereby amounting area thereof may be decreased.

In addition, since the coil parts are symmetrically mirrored on the basis of the central portion of the coil component, they may have the same inductance, whereby the mounting area may be decreased and efficiency of the inductor array chip may be improved.

While exemplary embodiments have been shown and described above, it will be apparent to those skilled in the art that modifications and variations could be made without departing from the scope of the invention as defined by the appended claims.

What is claimed is:

1. A coil component comprising:

a magnetic body including first and second coil parts disposed to be symmetrical to each other on one surface of a substrate on the basis of a central portion of the magnetic body and third and fourth coil parts disposed to be symmetrical to each other on the other surface of the substrate on the basis of the central portion of the magnetic body;

first to fourth external electrodes disposed on outer surfaces of the magnetic body and connected to the first to fourth coil parts, wherein the first and second coil parts are symmetrically mirrored with respect to the central portion of the magnetic body, and the third and fourth coil parts are symmetrically mirrored with respect to the central portion of the magnetic body, and each of the first to fourth coil parts has a higher coil density in a region thereof adjacent to the central portion of the magnetic body than in a region thereof adjacent to an end portion of the magnetic body, each of the first and second coil parts has the same coil density in a region adjacent to the central portion of the magnetic body, and each of the third and fourth coil parts has the same coil density in a region adjacent to the central portion of the magnetic body.

2. The coil component of claim 1, wherein the first and third coil parts are connected to each other through a via electrode.

3. The coil component of claim 1, wherein the second and fourth coil parts are connected to each other through a via electrode.

4. The coil component of claim 1, wherein the first and third external electrodes are input terminals, and the second and fourth external electrodes are output terminals.

5. The coil component of claim 1, wherein the first to fourth coil parts have the same length.

6. The coil component of claim 1, wherein the first to fourth coil parts contain at least one selected from the group consisting of gold, silver, platinum, copper, nickel, palladium, and alloys thereof.

7. The coil component of claim 1, wherein the substrate is a magnetic substrate.

8. A board having a coil component, the board comprising:

a printed circuit board on which a plurality of electrode pads are provided; and the coil component mounted on the printed circuit board, wherein the coil component includes:

a magnetic body including first and second coil parts disposed to be symmetrical to each other on one surface of a substrate on the basis of a central portion of the magnetic body and third and fourth coil parts disposed to be symmetrical to each other on the other surface of the substrate on the basis of the central portion of the magnetic body;

first to fourth external electrodes disposed on outer surfaces of the magnetic body and connected to the first to fourth coil parts, wherein the first and second coil parts are symmetrically mirrored on the basis of the central portion of the magnetic body, and the third and fourth coil parts are symmetrically mirrored on the basis of the central portion of the magnetic body, and each of the first to fourth coil parts has a higher coil density in a region thereof adjacent to the central portion of the magnetic body than in a region thereof adjacent to an end portion of the magnetic body, each of the first and second coil parts has the same coil density in a region adjacent to the central portion of the magnetic body, and each of the third and fourth coil parts has the same coil density in a region adjacent to the central portion of the magnetic body.

9. The board of claim 8, wherein the first and third coil parts are connected to each other through a via electrode.

10. The board of claim 8, wherein the second and fourth coil parts are connected to each other through a via electrode.

11. The board of claim 8, wherein the first and third external electrodes are input terminals, and the second and fourth external electrodes are output terminals.

12. The board of claim 8, wherein the first to fourth coil parts have the same length.

13. The board of claim 8, wherein the first to fourth coil parts contain at least one selected from the group consisting of gold, silver, platinum, copper, nickel, palladium, and alloys thereof.

14. The board of claim 8, wherein the substrate is a magnetic substrate.

* * * * *